US006776210B2

(12) United States Patent
Wells

(10) Patent No.: US 6,776,210 B2
(45) Date of Patent: Aug. 17, 2004

(54) SECTIONAL DOOR REINFORCING POST ASSEMBLY

(75) Inventor: David M. Wells, Arlington, TX (US)

(73) Assignee: Overhead Door Corporation, Dallas, TX (US)

( * ) Notice: Subject to any disclaimer, the term of this patent is extended or adjusted under 35 U.S.C. 154(b) by 0 days.

(21) Appl. No.: 10/342,722

(22) Filed: Jan. 15, 2003

(65) Prior Publication Data

US 2004/0134629 A1 Jul. 15, 2004

(51) Int. Cl.[7] ..... E05D 15/26
(52) U.S. Cl. ..... 160/209
(58) Field of Search ..... 160/209, 201, 160/133, 264, 181, 182

(56) References Cited

U.S. PATENT DOCUMENTS

| | | | | |
|---|---|---|---|---|
| 2,783,508 A | * | 3/1957 | Keating et al. | 160/209 |
| 3,424,223 A | * | 1/1969 | Rosenblatt | 160/209 |
| 3,443,625 A | * | 5/1969 | Moser et al. | 160/201 |
| 3,853,166 A | * | 12/1974 | Wrono | 160/201 X |
| 5,383,509 A | | 1/1995 | Gaffney et al. | |
| 5,445,207 A | | 8/1995 | Romanelli et al. | |
| 5,588,270 A | * | 12/1996 | Keating | 160/201 X |
| 5,620,038 A | | 4/1997 | DeCola et al. | |
| 5,706,877 A | | 1/1998 | Grisham et al. | |
| 5,732,758 A | | 3/1998 | Marko | |
| 5,819,834 A | | 10/1998 | Wedekind | |
| 5,964,269 A | | 10/1999 | Decola | |
| 5,967,216 A | | 10/1999 | Mancini | |
| 6,082,431 A | | 7/2000 | Decola | |
| 6,385,916 B1 | | 5/2002 | Marko | |
| 6,463,988 B1 | | 10/2002 | Mullet et al. | |

* cited by examiner

*Primary Examiner*—David Purol
(74) *Attorney, Agent, or Firm*—Gardere Wynne Sewell LLP

(57) ABSTRACT

A reinforcing post assembly for use with a sectional upward acting door to reinforce the door against high windloads includes an elongated C-channel shaped post reinforced with spaced apart gusset plates, and including retractable anchor pin members at its lower end. Elongated anchor links are mounted on the post upper end for engagement with a wall bracket which includes retainer pins and bosses formed thereon for retaining the links in a working position of the post. Spaced apart flexible cables are mounted on the post and may be connected at opposed eyes to retaining anchor pins mounted on the door sections and extending therebetween at spaced apart points on the door.

13 Claims, 7 Drawing Sheets

SECTIONAL DOOR REINFORCING POST ASSEMBLY

BACKGROUND

Sectional upward acting doors are ubiquitous as residential garage doors throughout storm prone geographical areas. The large, relatively unsupported portions of these doors make them particularly vulnerable to high windloads tending to collapse the door inwardly into the garage or outwardly through the garage door opening.

Several inventions have been developed for reinforcing garage doors to prevent damage resulting from atmospheric pressure differentials, commonly referred to as windloads. However, there has been a continuing need to provide improvements in sectional garage door reinforcing devices. Since the need to provide extra reinforcement for the door is only on infrequent occasions, it is desirable to provide a reinforcement which is temporary and can be disassembled and removed from the garage door opening when the threat of high windloads passes. In this way, the door itself is not required to be of extra strength and the unacceptable weight and higher cost resulting therefrom.

To meet the criteria mentioned above, sectional door reinforcing post assemblies have been developed which are temporary structures put in place during the threat of high windload atmospheric conditions. It is desirable to provide a reinforcing post assembly (or assemblies) which is easily and rapidly erected and taken down by the occupants of a residence or other structure at which the post is to be used, while at the same time providing a reinforcing post assembly which meets the criteria of reliable operation. It is to these ends that the present invention has been developed.

SUMMARY OF THE INVENTION

The present invention provides an improved reinforcing post assembly for use in reinforcing a sectional upward acting garage door against implosion or explosion resulting from windloads or other atmospheric caused differential pressures across the door.

In accordance with one important aspect of the invention, a door reinforcing post assembly is provided which includes an elongated tubular or channel shaped beam which is relatively lightweight, but vigorously resists bending loads. The post or beam includes an improved attachment mechanism at its upper end to facilitate ease of connection of the post to a fixed wall bracket disposed over the door opening. The post also includes easily actuated locking members or pins which are operable to support the lower end of the post assembly with respect to the garage floor.

In accordance with a further aspect of the invention, a door reinforcing post assembly is provided which includes plural flexible cable retainer straps which are cooperable with brackets and removable retainer pins mounted on adjacent sectional door panels in a manner that facilitates easy connection of the post assembly to the door panels and resist disconnection from the panels as a result of high windloads, vibrations and minor movements of the door during severe windload conditions.

The sectional door reinforcing post assembly of the present invention is easily adapted to operate in conjunction with a wide-variety of sectional doors, is easily installed during new construction or retrofitted to existing sectional doors, is economical to manufacture and does not require substantial training or instruction to install and remove with respect to its working position. Those skilled in the art will further appreciate the above-mentioned advantages and superior features of the invention upon reading the detailed description which follows in conjunction with the drawings.

DETAILED DESCRIPTION OF A PREFERRED EMBODIMENT

Figure 1:
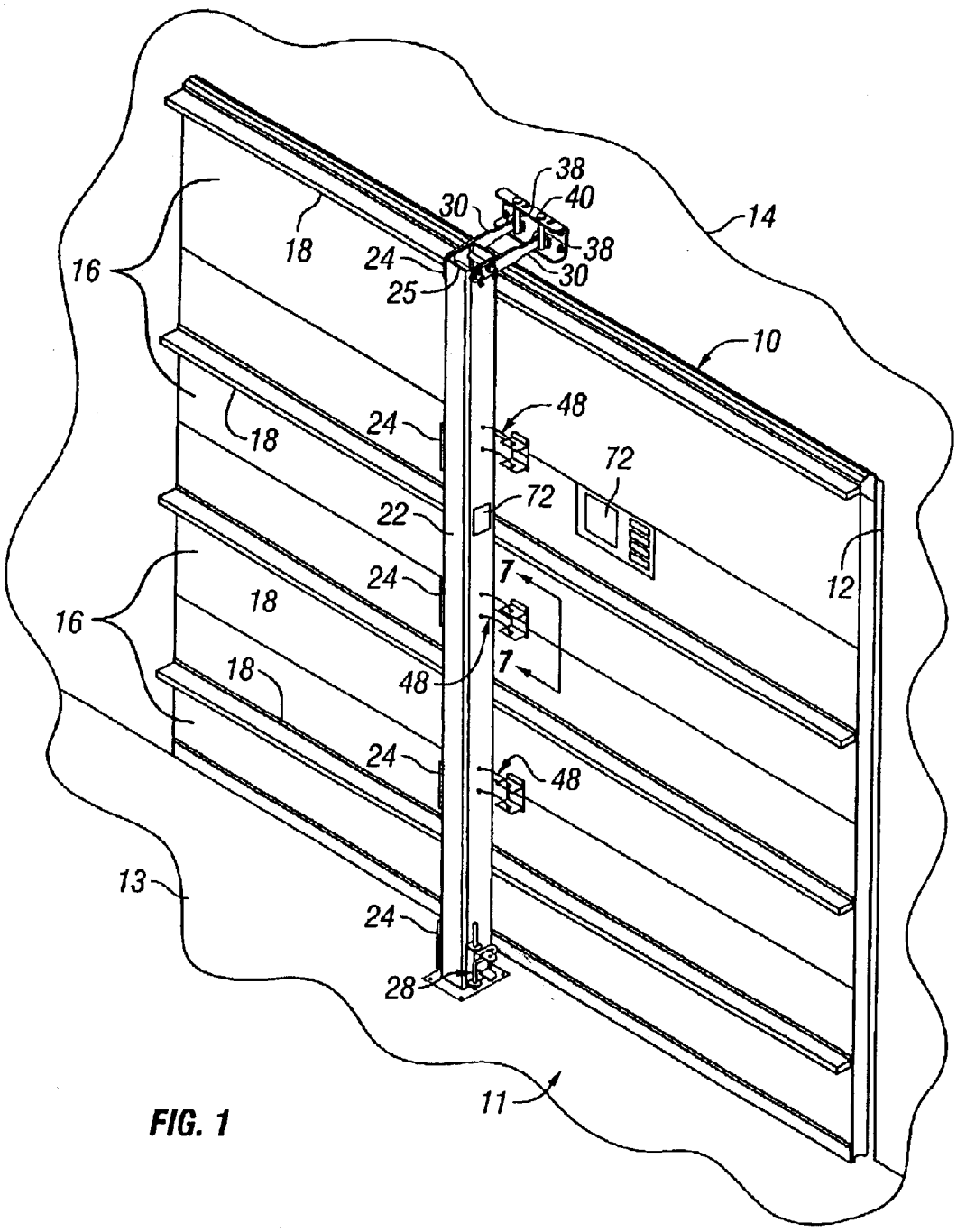
FIG. 1 is a perspective view showing the door reinforcing post assembly of the present invention in a working position for reinforcing a sectional upward acting garage door.

In the description which follows, like parts are marked throughout the specification and drawing with the same reference numerals, respectively. The drawing figures are not necessarily to scale and certain features may be shown in somewhat schematic or a generalized form in the interest of clarity and conciseness.

Referring to FIG. 1, there is illustrated a sectional upward acting garage door, generally designated by the numeral 10, disposed in a closed position covering an opening 12 in a garage wall 14. Certain structural features of the garage door 10 have been omitted from FIG. 1 in the interest of conciseness and such features include opposed guide tracks and a door operating mechanism, if furnished. However, the door 10 may be of the type disclosed in U.S. Pat. No. 6,328,091 to Whitley and assigned to the assignee of the present invention. U.S. Pat. No. 6,328,091 is incorporated herein by reference.

The door 10 is characterized by plural, hingedly interconnected, generally rectangular panels 16 which may be formed of folded sheet metal or plastic, for example, and adapted to include opposed guide members, not shown, operably connected to opposed guide tracks, also not shown, for moving the door between open and closed positions. Doors, such as the door 10, may be of various widths and the door 10 is illustrated as a relatively narrow width door (i.e., 8 ft. to 10 ft. width) requiring only one reinforcing post assembly in accordance with the invention. However, those skilled in the art will recognize that multiple reinforcing post assemblies may be used in conjunction with a sectional door, as required, depending on the overall width of the door and the door opening associated therewith.

Referring further to FIG. 1, the door sections or panels 16 are provided with horizontally extending reinforcing struts 18 suitably secured thereto and projecting inwardly within the garage space 11 from the respective door sections. As previously mentioned, the door sections or panels 16 may be of various configurations and may be either of the so-called pan configuration or provided with acoustic or thermal insulation, both as described in the above-referenced patent.

Referring still further to FIG. 1, a door reinforcing post assembly in accordance with the invention is illustrated and generally designated by the numeral 20. The post assembly is characterized by an elongated substantially rigid beam or post member 22 which may be formed of one of various structural member shapes, such as a rectangular cross-section tube, or of solid rectangular cross section construction or, in accordance with a preferred embodiment, may be formed as a generally C-shaped channel of relatively light gauge, see FIGS. 6 and 7 also. The C-shaped channel post member 22 may be reinforced by spaced apart gussets or reinforcing plates 24, one shown in FIGS. 6 and 7. The gusset plates 24 reinforce the C-shaped channel post member but the C-shaped channel member is of relatively lightweight steel or aluminum construction, for example, and thus is easily manipulated when required to be placed in or removed from the working position shown in FIG. 1.

Figure 2:
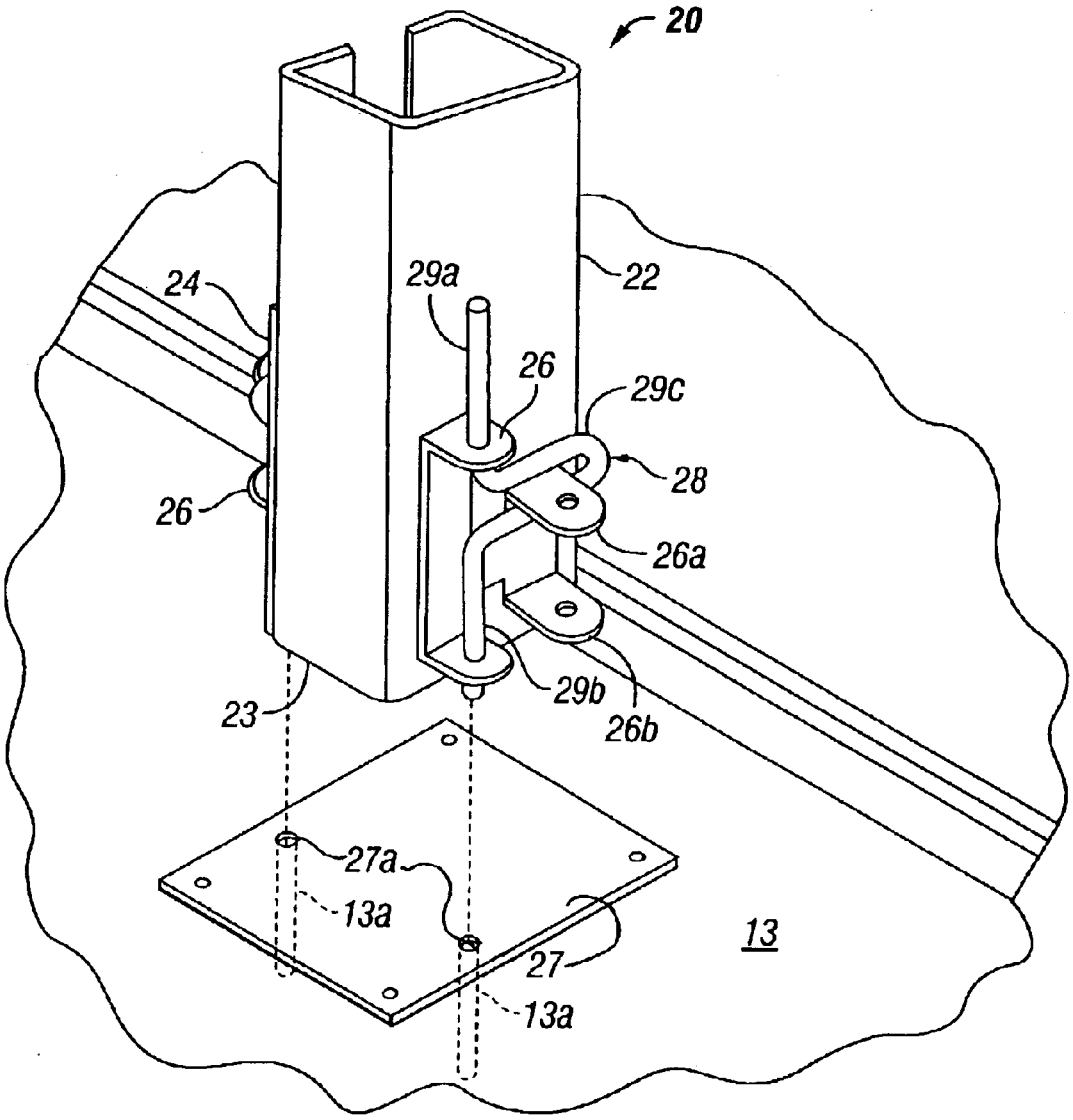
FIG. 2 is a detail perspective view on a larger scale showing the mechanism for securing the lower end of the door reinforcing post to a garage floor.

Referring also to FIG. 2, the lower end 23 of the post member 22 is provided with opposed generally C-shaped brackets 26, one shown in its entirety in FIG. 2, for supporting movable latch pins 28, one shown. Latch pin 28 includes opposed pin parts 29*a* and 29*b* which are disposed for sliding movement in suitable bores formed in bracket 26. Retainer pin 28 includes a somewhat U-shaped integral hasp 29*c* which may be placed in a stored position as shown in FIG. 2 or may be rotated clear of spaced apart tabs 26*a* and 26*b* and moved to a position disposed over tab 26*b* wherein pin part 29*b* then projects into a suitable bore 13*a* formed in garage floor 13. Pin 28 may be locked in either position described above by a retainer pin, not shown, projecting through suitable bores in the tabs 26*a* and 26*b*. As shown in FIG. 2, the post assembly 20 preferably includes a generally rectangular metal floor plate member 27 which may be suitably secured to garage door 13 for engagement with the lower end 23 of post 22. Suitable bores 27*a* formed in plate 27 are operable to receive the respective retainer pins 28 for extension into the aforementioned bores 13*a* in garage floor 13 for securing the lower end of the post assembly 20 in its working position.

Figure 3:
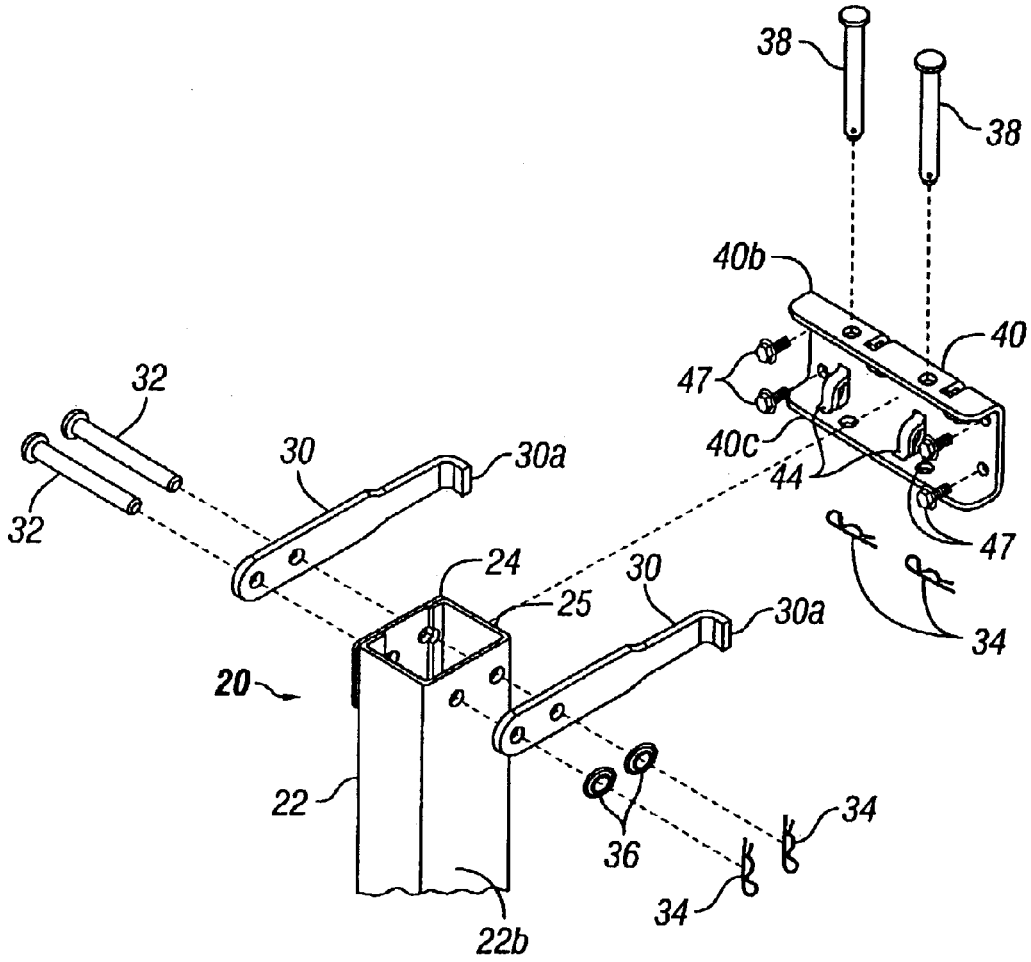
FIG. 3 is an exploded perspective view of the upper end of the post assembly shown in FIG. 1 and showing further details of a wall or header bracket and connecting links for securing the upper end of the post with respect to a garage wall.
Figure 4:
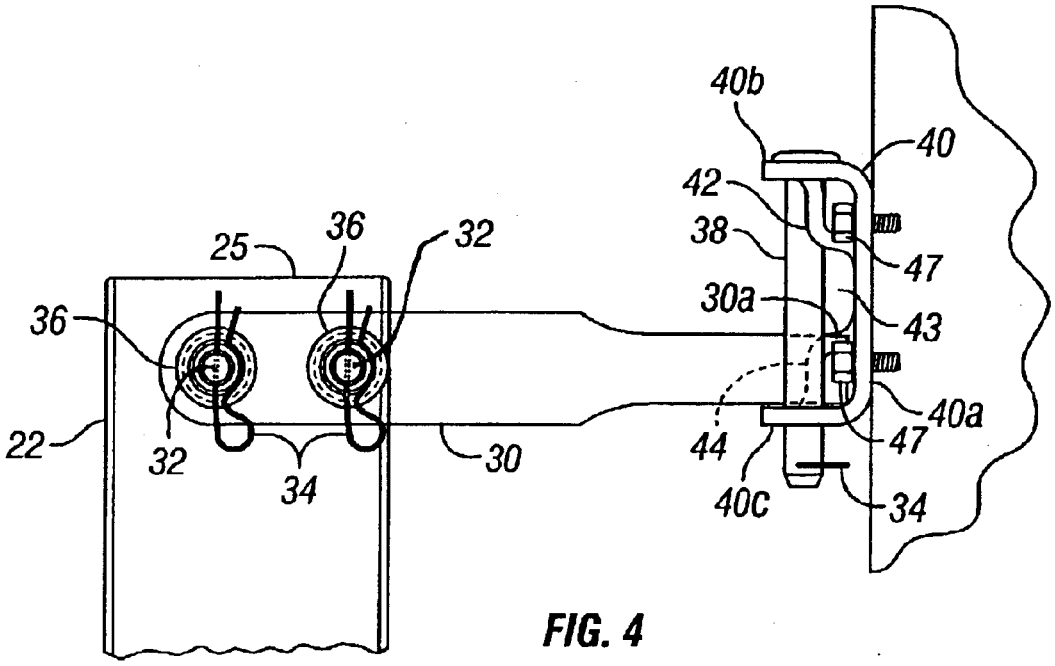
FIG. 4 is a side elevation of the upper end of the post assembly shown in FIG. 1 with the post connected to the wall bracket.

Referring again to FIG. 1, and also FIGS. 3 and 4, the upper end 25 of post member 22 is provided with two, opposed, elongated retainer links 30 which are adapted to be releasably secured to the upper end of the post by removable retainer pins 32 which extend through suitable bores formed in the links 30, as shown, as well as cooperating bores formed in a gusset plate 24 and in the upper end of the post member 22, as shown in FIG. 3. Pins 32 may be retained in their working positions by suitable keeper pins 34. Additionally, or alternatively, the retainer pins 32 may be retained in their working positions as shown in FIG. 1 by push-on type sheet metal retainer nuts 36 or by flat washers, not shown, in combination with the pins 34. At least one of the pins 32 may be removed from the position shown in FIG. 4 when the post assembly 20 is placed in storage so that the links 30 may, if desired, be pivoted to align themselves substantially with the longitudinal extent of post member 22 to thereby minimize any storage problems associated with the links extending laterally, as shown in FIGS. 1, 3 and 4. The push-on retainer nuts 36 may be used alone to secure the pins 32 in their working positions shown in FIG. 4.

Figure 5:
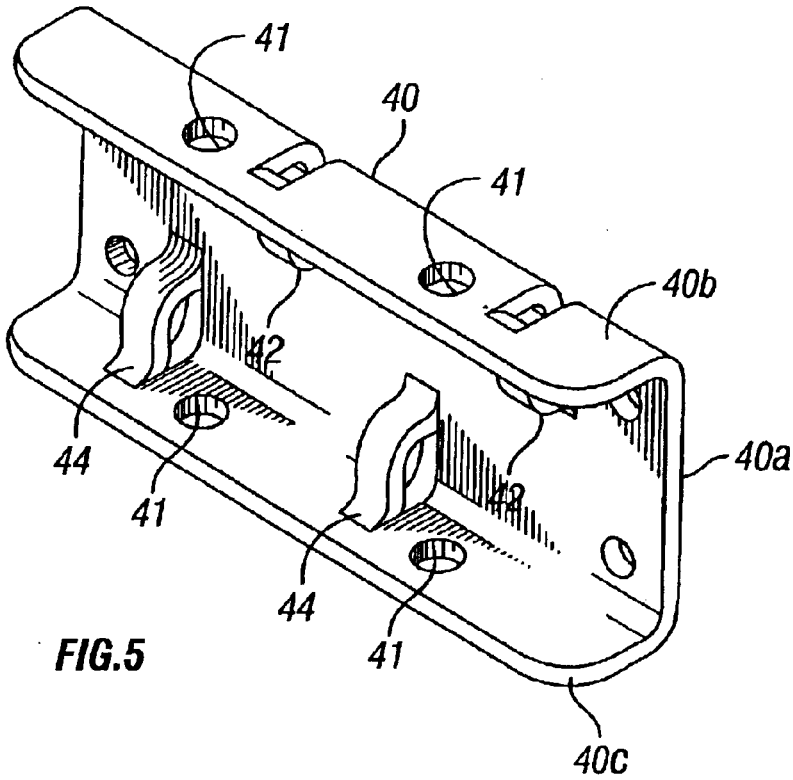
FIG. 5 is a perspective view of the wall bracket shown in FIGS. 1, 3 and 4.

The links 30 each include a distal hook part 30*a* adapted to engage a retainer pin 38, FIGS. 3 and 4, supported on a header or wall bracket 40 adapted to be secured to wall 14 generally above the door 10. As shown in FIGS. 3, 4 and 5, bracket 40 is characterized as a generally channel-shaped member having a central web 40*a* and opposed flanges 40*b* and 40*c*, see FIG. 5. Suitable aligned pin receiving bores 41 are formed in the respective flanges 40*b* and 40*c* for receiving the retainer pins 38. Pins 38 may be retained in their working positions by keeper pins or keys 34. Bracket 40 is also provided with opposed pairs of bosses 42 and 44 which are formed between the respective flanges 40*b* and 40*c* and the central web 40*a*, as shown in FIG. 5. The bosses 42 and 44 are arranged such that the bracket 40 may be mounted in a position where either the flange 40*b* or 40*c* is above the other. Conventional mechanical fasteners 47, FIG. 3, may be used to secure the bracket 40 to wall 14.

When the links 30 are positioned as shown in FIGS. 3 and 4 and secured to the upper end 25 of post 22 the post may be moved to its working position by registering the hook parts 30*a* of the links 30 between the pins 38 and the web 40*a* of bracket 40. Thanks to the provision of the bosses 42 and 44, the retainer links 30 may be positioned between the bosses 42 and 44 and moved laterally within a space 43, see FIG. 4, until the hook portions 30*a* engage pins 38 and are then lowered into a position such that they are trapped between the pins 38 and the bosses 44, for example, thus preventing the links from being disconnected from the bracket 40, such as is likely to occur when high windloads are causing the door 10 to vibrate and transfer such vibrations to the post assembly 20. However, the post assembly 20 may be usually manipulated by one person, thanks to its light weight and to the configuration of the retainer links 30 and the wall or header bracket 40, as described above.

Figure 6:
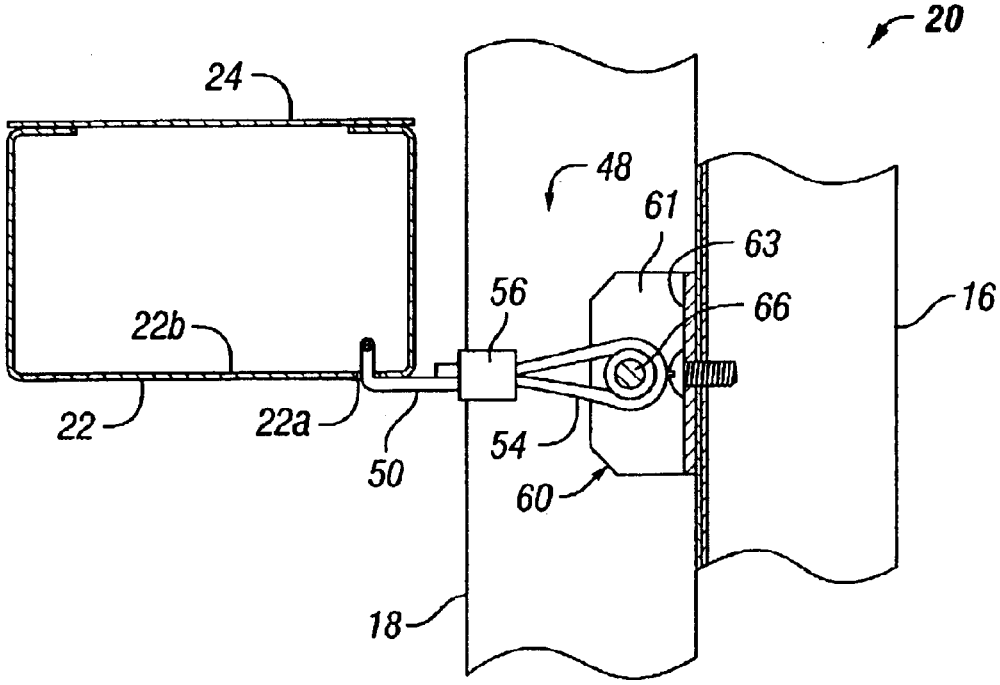
FIG. 6 is a detail view taken generally from the line 6—6 of FIG. 7.
Figure 7:
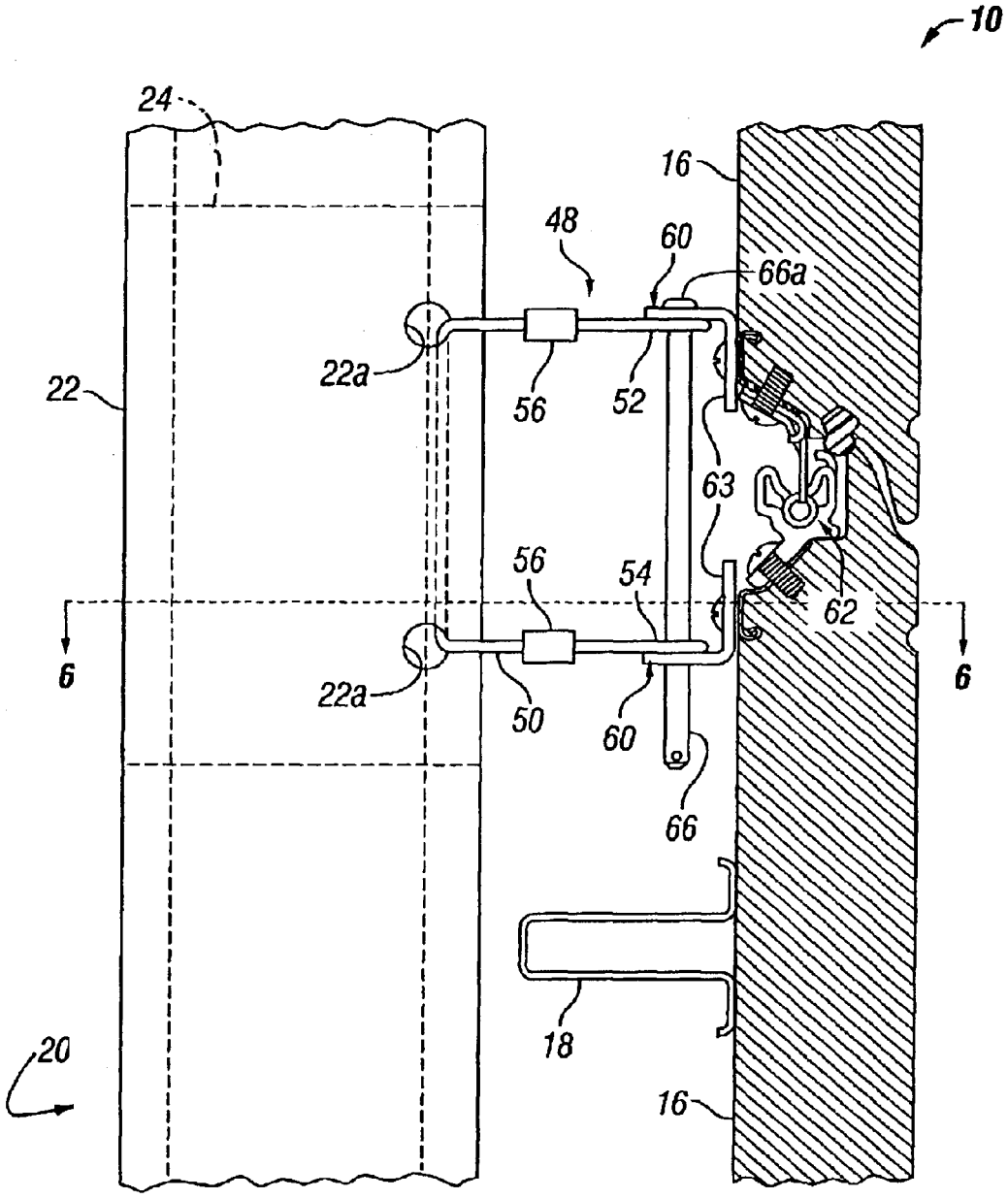
FIG. 7 is a detail view taken generally from the line 7—7 of FIG. 1.

The post assembly 20 may also be secured to each of the door panels or sections 16 by spaced apart flexible cable anchor assemblies 48, see FIGS. 1, 6 and 7. Referring to FIGS. 6 and 7, each of the cable type anchor assemblies 48 is characterized by an elongated flexible cable 50 formed of conventional wire rope, for example, and provided with cable eyes 52 and 54, see FIG. 9, at its opposite ends. Cable eyes 52 and 54 are of conventional configuration, and provided by beckets 56. Flexible cable 50 is trained through spaced apart openings 22*a* formed in web 22*b* of channel-shaped post member 22, see FIGS. 6 and 7. Cable 50 may be trained through the openings 22*a* prior to applying the beckets 56 to form the eyes 52 and 54 whereby the cable will then be retained attached to the post 22.

Figure 8:
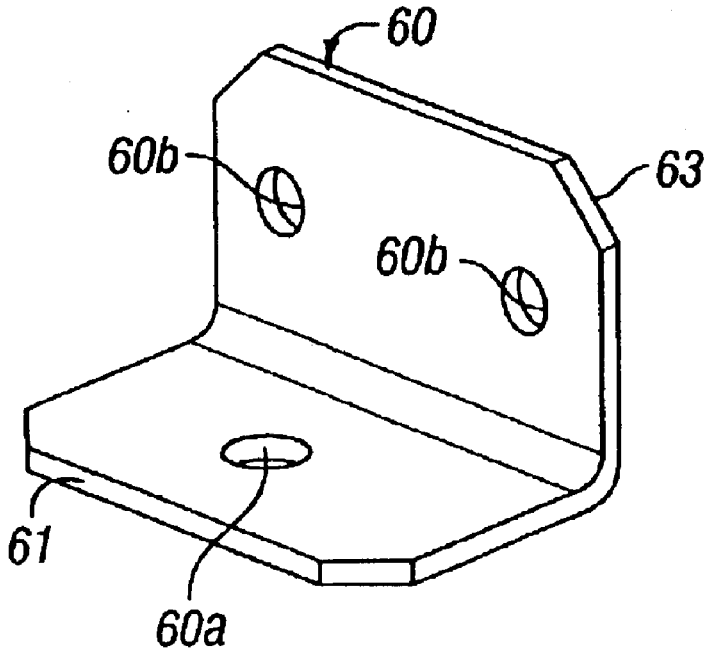
FIG. 8 is a perspective view of one of the door panel support brackets for the cable retainer pin shown in FIGS. 6 and 7.

As shown in FIGS. 6, 7 and 8, the panels 16 are provided with opposed somewhat angle or L-shaped brackets 60 suitably secured to upper and lower edges of adjacent panels, as shown in FIG. 6, and suitably fastened thereto with conventional mechanical fasteners. A preferred location of each bracket 60 is near a reinforced part of each of the panels 16, which part also supports a hinge assembly 62 which may be of a type described in U.S. Pat. No. 6,328,091. As shown in FIG. 8, each bracket 60 is preferably characterized as a somewhat angle shaped member having an anchor pin receiving bore 60*a* on a leg 61 and fastener receiving bores 60*b* formed on an opposed leg 63. Respective bores 60*a* of adjacent brackets 60 are aligned with each other and adapted to receive an elongated anchor pin 66, see FIGS. 6 and 7. Anchor pin 66 includes a head part 66*a* which is larger in diameter than the pin receiving bores 60*a* so that the pin remains extending between adjacent brackets 60, as shown in FIG. 7.

When the reinforcing windload post assembly 20 is placed in the position shown in FIG. 1, each of the cable type anchor assemblies 48 is connected to the door 10 by placing the cable eyes 52 and 54 between adjacent brackets 60 and inserting pin 66 through the respective cable eyes and the pin receiving bores 60*a* in the adjacent brackets. In this way, the door 10 is supported at spaced apart points at the respective hinge connections between adjacent panels 16 and against outward deflection through the door opening 12. Of course, the door panels 16 are braced against substantial inward deflection by engagement of the struts 18 with the post or post assemblies 20, since only a small amount of clearance space is provided between the post 22 and the struts 18, see FIGS. 6 and 7, in the normal position of the door 10.

Figure 9:
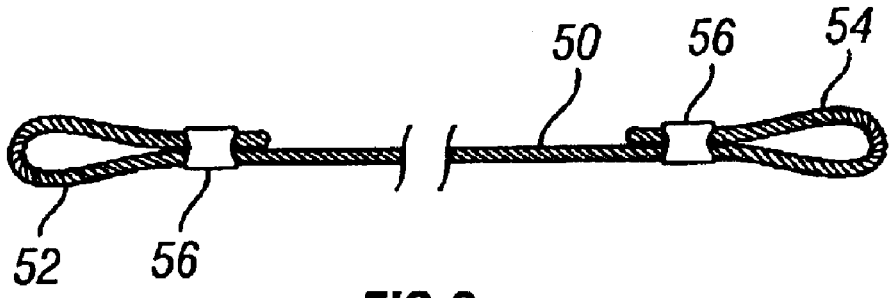
FIG. 9 is a plan view of one of the flexible cable retainers for the reinforcing post assembly of the present invention.

One particular advantage of the cable type anchor assemblies 48 resides in the fact that the cable 50 is, in a relaxed condition, normally substantially straight but allows elastic deflection to the positions of the cable eyes 52 and 54, as shown in FIGS. 1 and 7. However, since the cable eyes 52 and 54 are disposed between the opposed and adjacent brackets 60 and are biased to assume a substantially flat or linear condition, as shown in FIG. 9, the eyes 52 and 54 are biased to engage the bracket legs 61 facilitating ease of connecting the cable anchor assemblies 48 to the door sections when the pin 66 is to be inserted into its working position. Moreover, the elastic bias of each cable assembly 48 also aids in retaining the pins 66 in their working positions even when the reinforcing post assembly 20 and the door 10 are subjected to substantial vibrations normally encountered in severe storm conditions and the windloads produced thereby. Still further, providing the anchor pins 66 extending between adjacent panels 16 at the hinge points provides added stiffness and deflection resistance with respect to adjacent panels.

The construction and operation of the door reinforcing post assembly of the present invention is believed to be readily understandable to those of skill in the art based on the foregoing description. The post member 22 and the components connected thereto may be fabricated using conventional manufacturing techniques and conventional engineering materials. The C-channel configuration of the post member 22 is a preferred configuration, particularly as modified by the reinforcing gusset plates 24. However, other shapes, materials and configurations of posts may be used in place of the embodiment illustrated while enjoying the other benefits of the invention.

During normal use of the door 10, the post assembly 20 is stored in an out of the way place in the garage, for example, wherein it is to be used. However, when the post assembly 20 is placed in use positioned generally over the floor plate 27 with the links 30 in their working positions, as shown in FIGS. 1 and 4, the post member 22 is moved into a position such that the distal finger parts or portions 30a are aligned with the space 43 between the bosses 42 and 44. The post member 22 is then moved laterally into a position to engage the pins 38 and then lowered slightly until the links 30 are in the position shown in FIG. 4. In this position, the links 30 are anchored firmly to the bracket 40 since they engage the pins 38 on one side and are engageable when the bosses 44 if there is any movement tending to disconnect the links from the bracket 40. After positioning the post 22 to form the connection described above, the bottom end 23 of the post is adjusted to align the pins 28 with the openings 27*a* whereby these pins are then moved to a position where the pin ends 29*b* drop into the pin receiving bores 13*a* in the floor 13.

After locating the post assembly 20 as described above, the anchor cables 50 are positioned to receive the pins 66 whereupon these pins are inserted through the receiving bores 60*a* in the adjacent brackets 60 to anchor the door sections to the post 22. Disassembly of the reinforcing post assembly 20 from the door 10 may be carried out by substantially reversing the procedure just described.

Those skilled in the art will recognize from the foregoing description that an improved door reinforcing post assembly is provided by the present invention and comprises a post assembly which is economical to manufacture and may be easily and conveniently placed in its working position by a person not familiar with its use. In this last mentioned regard printed instructions may be placed on the door 10 as well as on the post member 22, as indicated by numeral 72 in FIG. 1. Although the post assembly 20 is advantageously used in conjunction with a sectional door, such as the door 10, the post assembly may also be used in conjunction with one piece or so called California type doors as well as horizontal swing doors, for example.

A preferred embodiment of the invention has been described in detail herein. However, those skilled in the art will further recognize that various substitutions and modifications may be made to the invention without departing from the scope and spirit of the appended claims.

What is claimed is:

1. A reinforcing post assembly for a multi-section door adapted to be disposed over an opening in a garage wall, said reinforcing post assembly including:

an elongated post member including an upper end and a lower end;

a member associated with said lower end of said post member for anchoring said post member to a garage floor;

a wall bracket secured to said wall generally above said door in a closed position of said door;

a link connected to said upper end of said post member and adapted to be connected to said wall bracket;

spaced apart anchor cables disposed on said post member and operable to be connected to said door for reinforcing said door against windloads in at least one direction, each of said cables including opposite ends;

spaced apart pairs of brackets connected to said door for connecting said door to said cables at opposite ends thereof, respectively; and said pairs of brackets are aligned to receive a cable anchor pin and each of said cables includes opposed eye parts at opposite ends for receiving said cable anchor pin to connect said cables to said door, respectively.

2. The reinforcing post assembly set forth in claim 1 wherein:

said cables are each elastically deflectable to engage pairs of said brackets, respectively, to maintain said cables snugly engaged with said brackets of said pairs of brackets, respectively.

3. The reinforcing post assembly set forth in claim 1 wherein:

said wall bracket includes spaced apart finger engaging parts thereon arranged for engagement with a finger part of said link to retain said link connected to said wall bracket.

4. The reinforcing post assembly set forth in claim 1 wherein:

said link is secured to said upper end of said post member by removable pin members.

5. The reinforcing post assembly set forth in claim 4 wherein:

said pin members are secured to said link and to said post by push-on nut type fasteners, respectively.

6. The reinforcing post assembly set forth in claim 1 wherein:

said post member comprises a C-shaped channel member having a web and opposed flanges and spaced apart gusset plates secured to said channel member for reinforcing said post member.

7. The reinforcing post assembly set forth in claim 1 wherein:

said member for anchoring said lower end of said post member to a garage floor comprises at least one pin mounted for sliding movement on said post member between a retracted position and an extended position insertable in a bore formed in said garage floor.

8. A reinforcing post assembly for a sectional door characterized by plural hingedly interconnected generally planar door sections adapted to be disposed over an opening in a garage wall, said reinforcing post assembly including:

an elongated post member including an upper end and a lower end;

a post anchor associated with said lower end of said post member for anchoring said post member to a garage floor;

a wall bracket secured to said wall generally above said door in a closed position of said door;

at least one link connected to said upper end of said post member and adapted to be connected to said wall bracket by moving said post member laterally toward said wall bracket for connecting said post member to said wall bracket;

spaced apart flexible cable assemblies secured to said post member and operable to be connected to said door at spaced apart hinge connection points thereon for reinforcing said door against windloads;

said door sections include spaced apart anchor brackets for connecting said adjacent sections to said cable assemblies at opposite ends thereof, respectively; and respective pairs of said anchor brackets are aligned to receive a cable anchor pin in supportive relationship thereto extending across a hinge point between adjacent sections and connected to opposite ends of said cable assemblies, respectively.

9. The reinforcing post assembly set forth in claim 8 wherein:

said wall bracket includes spaced apart finger engaging members thereon and arranged for retaining a finger part of said link connected to said wall bracket.

10. A reinforcing post assembly for a sectional door characterized by plural hingedly interconnected generally planar door sections adapted to be disposed over an opening in a garage wall, said reinforcing post assembly including:

an elongated post member including an upper end and a lower end;

a post anchor associated with said lower end of said post member for anchoring said post member to a garage floor;

a wall bracket secured to said wall generally above said door in a closed position of said door;

at least one link connected to said upper end of said post member and adapted to be connected to said wall bracket by moving said post member laterally toward said wall bracket for connecting said post member to said wall bracket;

flexible cable assemblies disposed spaced apart on said post member and adapted to be connected to respective adjacent sections of said door at spaced apart hinge connection points thereon for reinforcing said door against windloads;

said door sections include spaced apart anchor brackets for connecting said adjacent sections to said cable assemblies at opposite ends thereof, respectively;

respective pairs of said anchor brackets are aligned to receive a cable anchor pin in supportive relationship thereto and extending across a hinge point between adjacent sections; and said cable assemblies each include opposed eye parts for receiving an anchor pin to connect said cable assembly to said door at pairs of said anchor brackets, respectively.

11. The reinforcing post assembly set forth in claim 10 wherein:

said cable assemblies are elastically deflectable to engage said pairs of said anchor brackets to maintain said cable assemblies snugly engaged with said anchor brackets.

12. A reinforcing post assembly for a door adapted to be disposed over an opening in a garage wall, said reinforcing post assembly including:

an elongated C-channel post member including an upper end and a lower end, said post member being reinforced at spaced apart points thereon by respective gusset plates;

a post anchor associated with said lower end of said post member for anchoring said post member to a garage floor;

a wall bracket secured to said wall generally above said door in a closed position of said door;

spaced apart links connected to said upper end of said post member, respectively, and including hook shaped finger parts, respectively, adapted to be connected to said wall bracket by moving said post member substantially laterally toward said wall bracket; and spaced apart flexible cable anchor assemblies disposed on said post member and operable to be connected to said door at spaced apart points thereon for reinforcing said door against windloads.

13. A reinforcing post assembly for a door adapted to be disposed over an opening in a garage wall, said reinforcing post assembly including:

an elongated post member including an upper end and a lower end;

a post anchor associated with said lower end of said post member for anchoring said post member to a garage floor;

a wall bracket secured to said wall generally above said door in a closed position of said door;

spaced apart links connected to said upper end of said post member, respectively, and including hook shaped finger parts, respectively, adapted to be connected to said wall bracket by moving said post member substantially laterally toward said wall bracket; and spaced apart flexible cable anchor assemblies disposed on said post member and operable to be connected to said door at spaced apart points thereon for reinforcing said door against windloads, said cable anchor assemblies each include a flexible cable connected to said post member and to an anchor pin connected to adjacent sections of said door and extending therebetween.

* * * * *